US007401372B2

(12) United States Patent
Sebor

(10) Patent No.: US 7,401,372 B2
(45) **Date of Patent: *Jul. 22, 2008**

(54) SWIMMING POOL CLEANING APPARATUS

(76) Inventor: Pavel Sebor, 751 Cricklewood Terr., Heathrow, FL (US) 32746

( * ) Notice: Subject to any disclaimer, the term of this patent is extended or adjusted under 35 U.S.C. 154(b) by 0 days.

This patent is subject to a terminal disclaimer.

(21) Appl. No.: 11/564,371

(22) Filed: Nov. 29, 2006

(65) Prior Publication Data

US 2007/0136962 A1 Jun. 21, 2007

Related U.S. Application Data

(63) Continuation-in-part of application No. 11/219,485, filed on Sep. 2, 2005, now Pat. No. 7,159,263, and a continuation of application No. 10/621,070, filed on Jul. 16, 2003, now Pat. No. 6,966,092.

(60) Provisional application No. 60/396,208, filed on Jul. 16, 2002.

(51) Int. Cl.
*E04H 4/16* (2006.01)

(52) U.S. Cl. ..... 15/1.7; 137/494

(58) Field of Classification Search ..... 15/1.7; 137/494

See application file for complete search history.

(56) References Cited

U.S. PATENT DOCUMENTS 3,481,250 A 12/1969 Toby
4,023,227 A 5/1977 Chauvier
4,133,068 A 1/1979 Hofmann
4,208,752 A 6/1980 Hofmann
4,351,077 A 9/1982 Hofmann
4,463,468 A 8/1984 Chauvier
5,341,847 A 8/1994 Rissik et al.
5,404,607 A 4/1995 Sebor
5,706,540 A 1/1998 Niewiarowski
5,794,293 A 8/1998 Hoffinger
5,797,156 A 8/1998 Sebor
5,970,557 A 10/1999 Supra
6,112,354 A 9/2000 Stoltz et al.
6,119,293 A 9/2000 Phillipson et al.
6,237,175 B1 5/2001 Phillipson et al.
6,298,513 B1 10/2001 Rief et al.
6,311,353 B1 11/2001 Phillipson et al.
6,463,614 B1 10/2002 Supra
2002/0002750 A1 1/2002 Phillipson et al.
2002/0116772 A1 8/2002 Phillipson et al.
2002/0166185 A1 11/2002 Balint

*Primary Examiner*—Randall Chin
(74) *Attorney, Agent, or Firm*—Allen, Dyer, Doppelt, Milbrath & Gilchrist, P.A.

(57) ABSTRACT

A submersible cleaner includes a valve within a flow passage for interrupting fluid flow and thus drive the cleaned over submerged surfaces to be cleaned. An element moveable between the valve and a wall surface within the passage reduces a gap formed between them such that flow through the passage is directed along one side of the valve resulting in improved driving power and reduced clogging by debris passing through the passage. The element may be attached to either the valve or the wall, and may make slideable engagement with them. A flexible plate engaging the surface includes a plurality of tongues radially extending about the periphery with each tongue having a lower surface portion contacting the surface to be cleaned and an outmost portion contoured away from the surface.

25 Claims, 16 Drawing Sheets

SWIMMING POOL CLEANING APPARATUS

CROSS-REFERENCE TO RELATED APPLICATIONS

This application is a continuation-in-part of Utility Application Ser. No. 11/219,485, filed Sep. 2, 2005, which is a continuation of Utility Application Ser. No. 10/621,070, filed Jul. 16, 2003 issuing as U.S. Pat. No. 6,966,092 which claims priority to Provisional Application No. 60/396,208 for Swimming Pool Cleaning Apparatus and Method, filed Jul. 16, 2002, the disclosures of which are hereby incorporated by reference herein in their entireties, and all commonly owned.

FIELD OF THE INVENTION

The present invention generally relates to self propelled swimming pool cleaners for cleaning submerged surfaces, and more particularly to a swimming pool cleaning apparatus incorporating a flow control valve for establishing intermittent flow of a fluid through the cleaner for causing the cleaner to travel across the surface to be cleaned.

BACKGROUND OF THE INVENTION

Submersible pool cleaners employing oscillating valves within a housing and flexible discs engaging the surface to be cleaned are generally well known, as illustrated by way of example with reference to U.S. Pat. Nos. 4,023,227 to Chauvier and U.S. Pat. No. 4,351,077 to Hofmann. What is also generally known are the problems associated with debris clogging fluid flow passages, wearing cleaner components rendering the cleaner ineffective or unusable, and the difficulty for a consumer attempting to replace such worn components. Embodiments of the present invention herein described provide an efficiently run submersible cleaner which includes components that are easily replaceable by the consumer.

SUMMARY OF THE INVENTION

A submersible cleaner in keeping with the teachings of the present invention may include a housing moveable along a submerged surface to be cleaned through fluid flow past a valve operable for moving the cleaner. The housing may include a flow passage for a flow of fluid and debris from an inlet to an outlet with the fluid and debris constrained to flow through an opening defined within the passage. A wall surface may extend into the flow passage for defining the opening. A valve may be operable within the flow passage for interrupting fluid flow. An element acting between the valve distal end and the wall surface reduces a gap formed between them. The element may be attached to either the valve or the wall, and may make slideable engagement with the wall or the valve distal end. The element as herein referenced is generally retractable from or moveable away from the wall surface with which it operates and may be desirable as retractable, pivotable, or flexible and may or may not fully close the gap.

A flexible plate may be carried proximate the inlet for engaging the surface to be cleaned. The flexible plate may be described to include an upper surface, an opposing lower surface for contacting the surface to be cleaned, and a periphery defined by a plurality of tongues radially extending about the periphery. Each of the plurality of tongues may include a lower surface portion for contacting the surface to be cleaned and a contouring portion in a spaced relation with the surface to be cleaned during operation of the apparatus, thus upwardly lifting an outer most periphery of the plate from the surface to be cleaned. A plurality of reinforcing elements may be integrally formed with the flexible plate for upwardly contouring the periphery from the surface to be cleaned. The reinforcing elements may include a rib that may be integrally formed with the upper surface of the flexible plate with the rib extending radially outward while confined within the periphery of the flexible plate. Alternatively, the reinforcing element may comprise a flange extending along the peripheral edge of the tongue, or yet other reinforcing styled elements.

BRIEF DESCRIPTION OF THE DRAWINGS

Embodiments of the invention are described by way of example with reference to the accompanying drawings in which.

DETAILED DESCRIPTION OF THE PREFERRED EMBODIMENTS

Embodiments of the present invention will now be described more fully with reference to the accompanying drawings. It will be understood by those skilled in the art that this invention may be embodied in many different forms and should not be construed as limited to the embodiments set forth herein. Rather, these embodiments are provided so that this disclosure will be thorough and complete, and will fully convey the scope of the invention to those skilled in the art. Like numerals refer to like elements.

Figure 1:
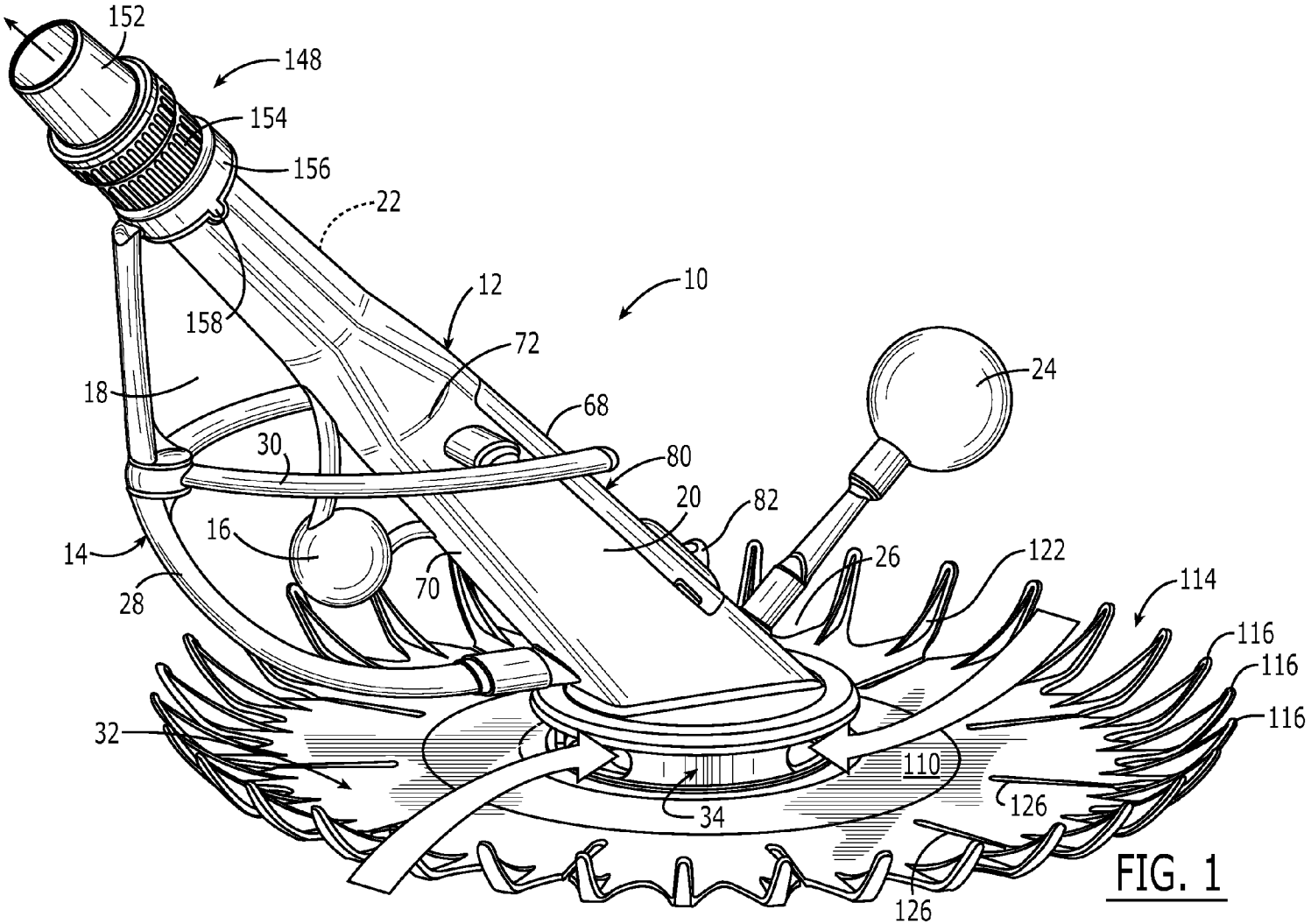
FIG. 1 is a left side perspective view of one embodiment of a swimming pool cleaner according to the present invention.
Figure 2:
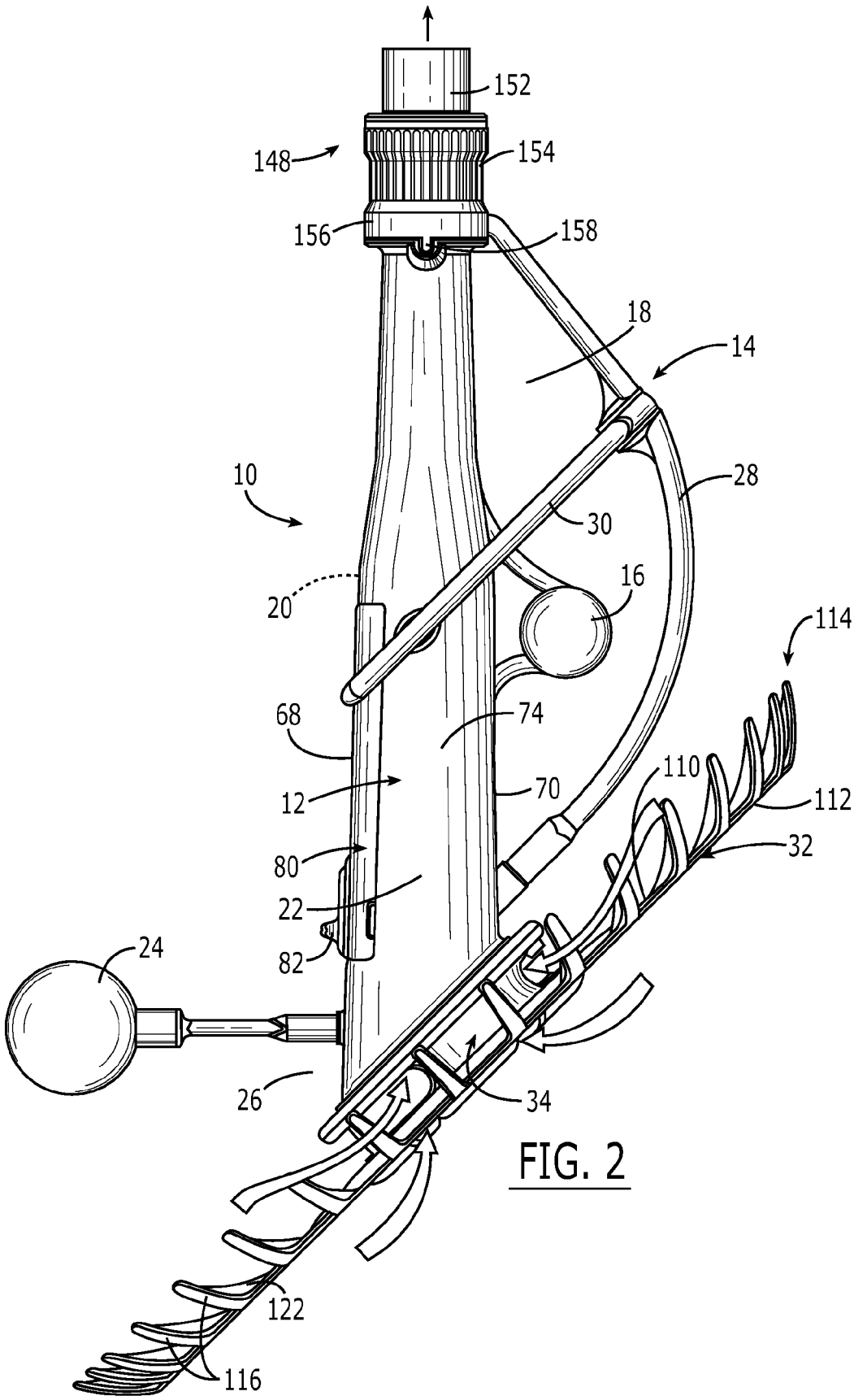
FIG. 2 is a right side elevation view of the cleaner of FIG. 1.

With reference initially to FIGS. 1 and 2, an embodiment of the present invention is herein described, by way of example, for a submersible swimming pool cleaner 10 having a housing 12 inclined toward a direction of travel, which housing carries a bumper 14 and weight 16 about a forward portion 18 with the bumper extending to left and right side portions 20, 22. A float 24 is carried at an aft portion 26 for acting in conjunction with the weight 16 in allowing the cleaner 10 to fall to an upright position when dropping from a sidewall of a swimming pool. Vertical and horizontal bumper members 28, 30 are effective in having the cleaner avoid obstructions within the swimming pool, such as steps and sharp corners. The housing 12 further carries a flexible plate 32 via attachment with a footpad 34.

The housing 12 includes a single flow passage 36 extending from an inlet 38 to an outlet 40 for a flow of fluid and debris through the passage, as described with reference to FIG. 3. A wall surface or partition wall 42 extends into the single flow passage 36 such that the flow of fluid and debris (illustrated with arrows 44) are constrained to pass through an opening 46 formed thereby and pass to the outlet 40, which outlet is adapted for connection to a suction source 48. The flexible plate 32 is carried about the inlet 38 for engaging a submerged surface 50 to be cleaned. A valve 52 is pivotally carried within the flow passage 36 for interrupting fluid flow 44 through the passage during an oscillation of the valve between a seated position 54 for interrupting the flow to an unseated position 56 permitting the flow, as illustrated with reference to FIGS. 4 and 5. The valve 52 interrupts flow through the passage 36 resulting in a motion of the inclined housing 12 causing it to travel along the surface of the pool to be cleaned, the valve thus acting as the "motor" for the pool cleaner. With continued reference to FIG. 3, a suction of the fluid through the flow passage 36 causes an oscillating of the valve between the seated and the unseated positions and a resulting movement of the cleaner 10 across the submerged surface 50.

Figure 3:
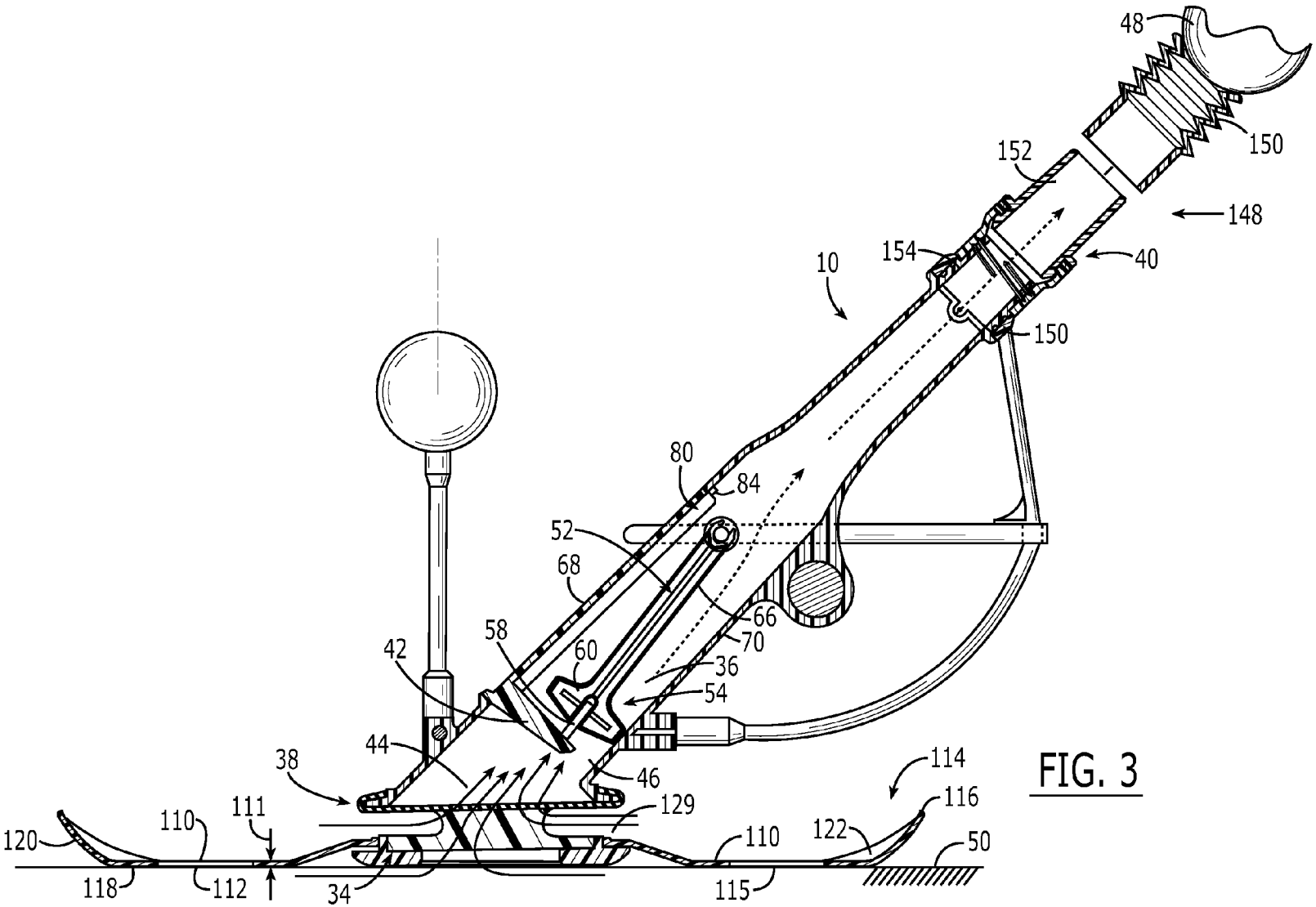
FIG. 3 is a partial cross section view of a pool cleaner illustrating fluid flow therethrough.
Figure 4:
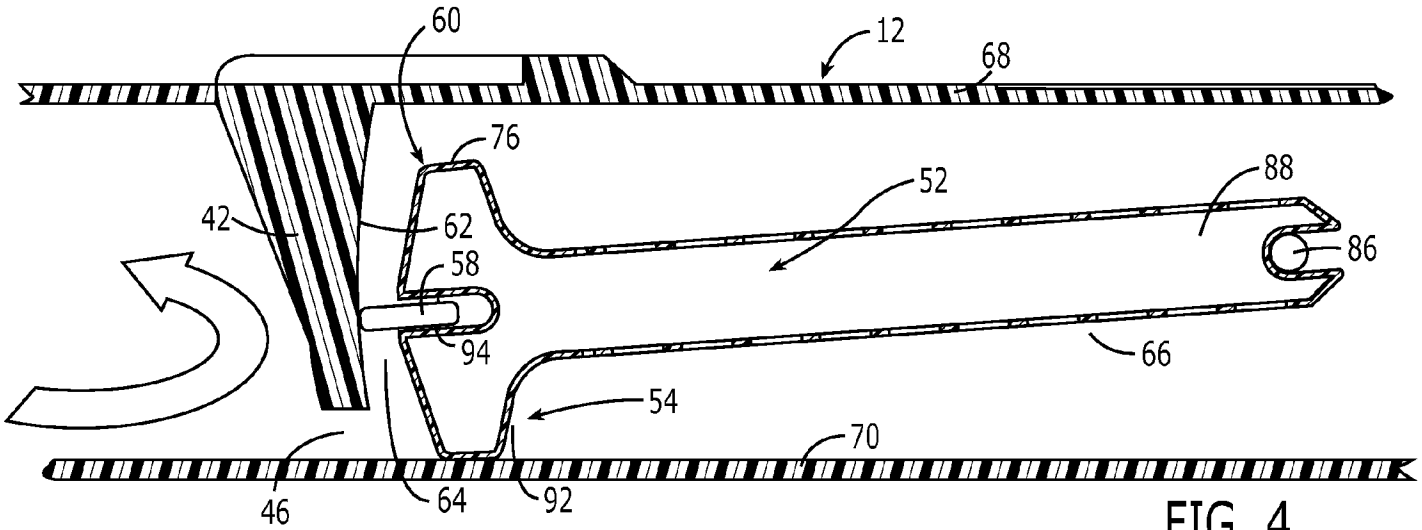
FIGS. 4 and 5 are partial cross section view of a housing portion of the embodiment of FIG. 3 illustrating an enlarged view of the oscillator valve in a seated position and an unseated position, respectively.
Figure 5:
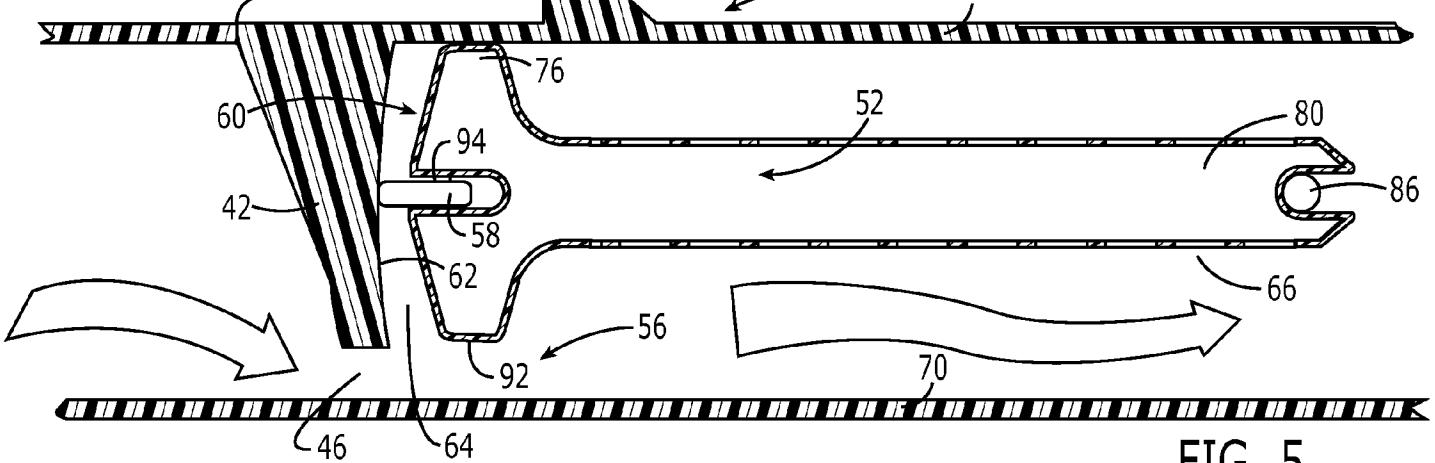
Figure 6:
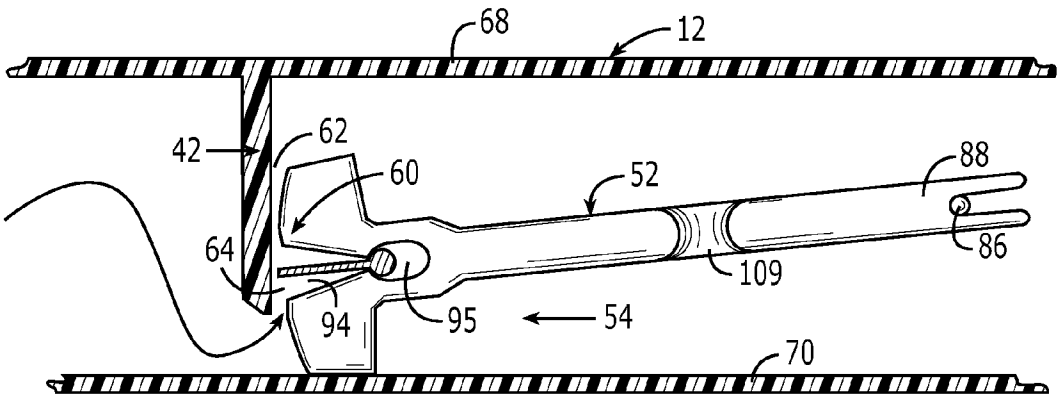
FIG. 6 is an alternate embodiment of the valve in keeping with the teachings of the present invention.

With continued reference to FIGS. 3-5, an element 58 acts between a valve distal end 60 and a surface 62 of the partition wall 42 for reducing a gap 64 formed between them, thus substantially limiting the flow of the fluid and debris to only one side 66 of the valve 52. For the embodiment herein illustrated by way of example in FIGS. 3-5, the element 58 is herein referenced to as a retractable element 58 and may be dimensioned such that the fluid flow through the passage 36 causes the retractable element to have slidably engagement between the valve distal end 60 and the surface 62 of the partition wall 42 during the oscillation of the valve, as illustrated with reference again to FIGS. 4 and 5, or alternatively may fully close or simply reduce the size of the gap 64, as illustrated with reference to FIG. 6.

With reference again to FIGS. 1-5, the single flow passage 36 may be defined by opposing top and bottom walls 68, 70 in combination with opposing left and right sidewalls 72, 74, wherein the distal end 60 of the valve 52 contacts the bottom wall 70 in the seated position 54 and oscillates between the seated position and a stop 76 formed with the distal end 60 for contacting the top wall 68.

Figure 7:
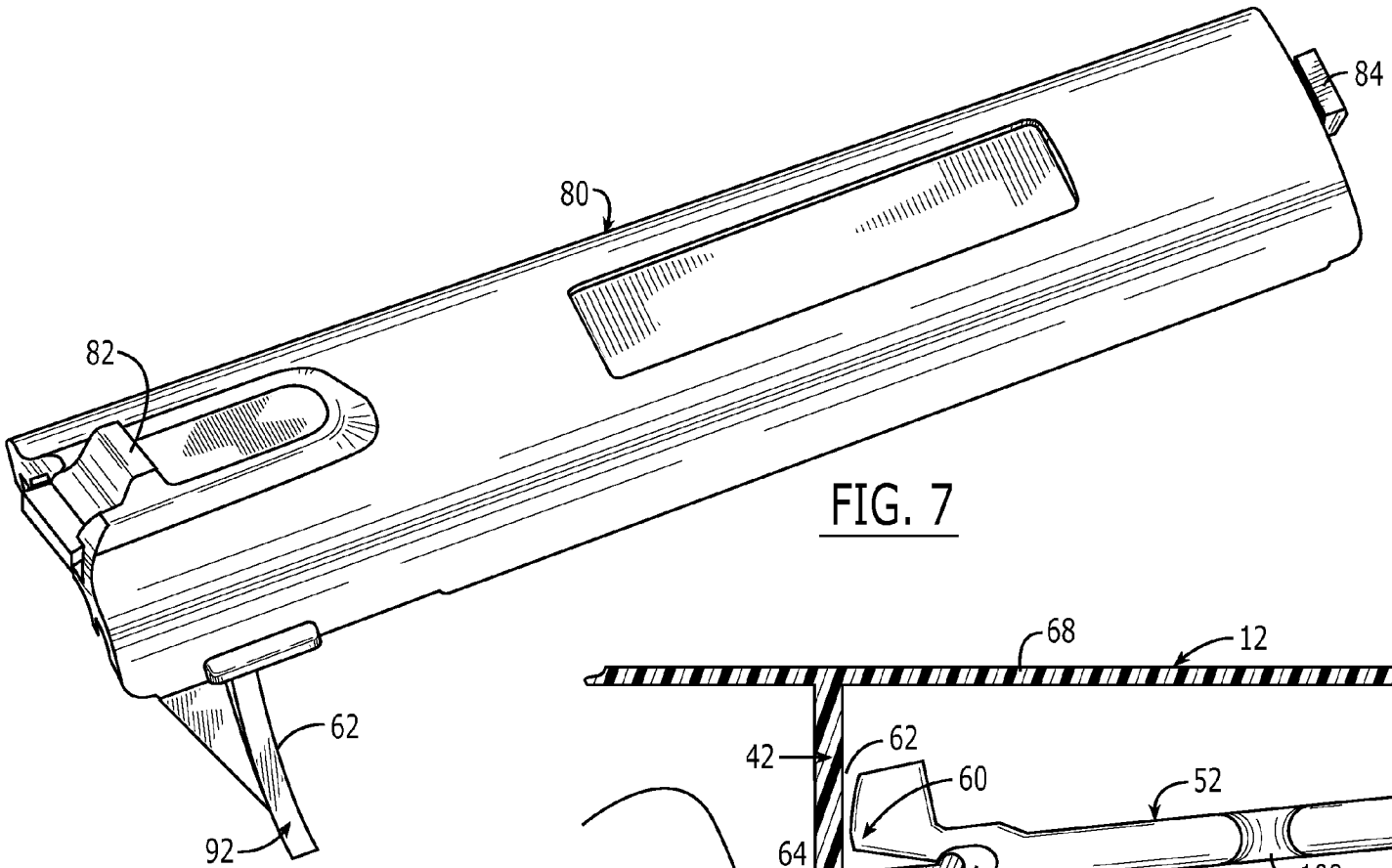
FIG. 7 is a perspective view of a cover.
Figure 8:
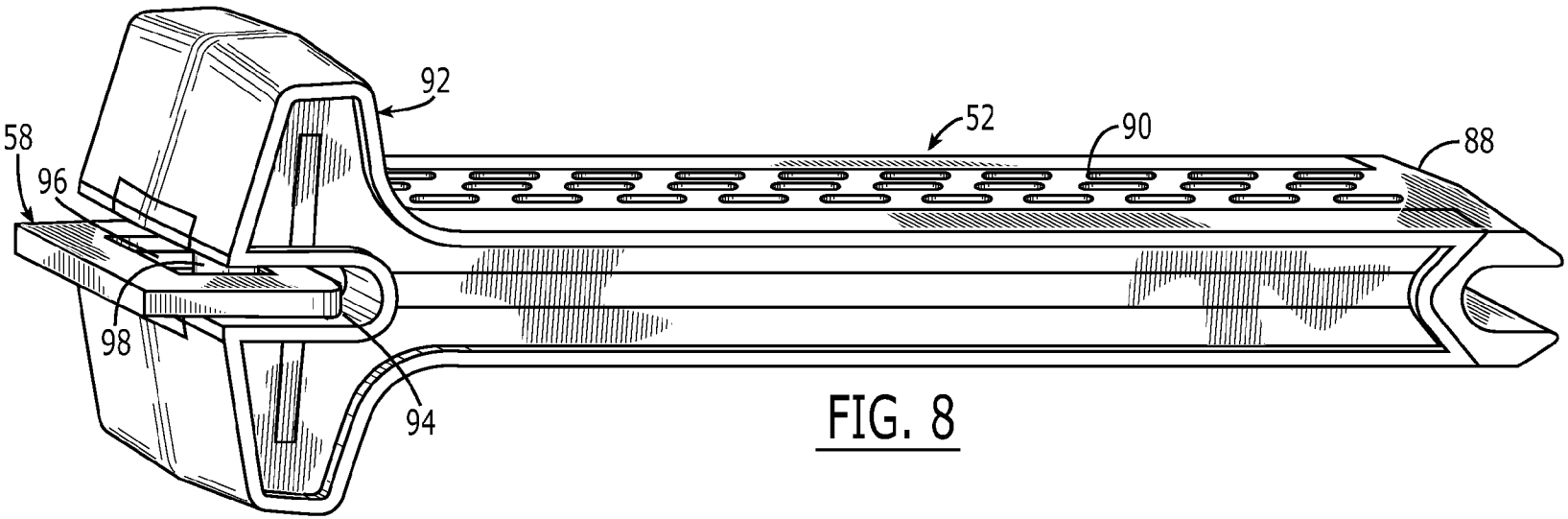
FIGS. 8 and 9 are perspective and side views of an embodiment of a valve.
Figure 9:
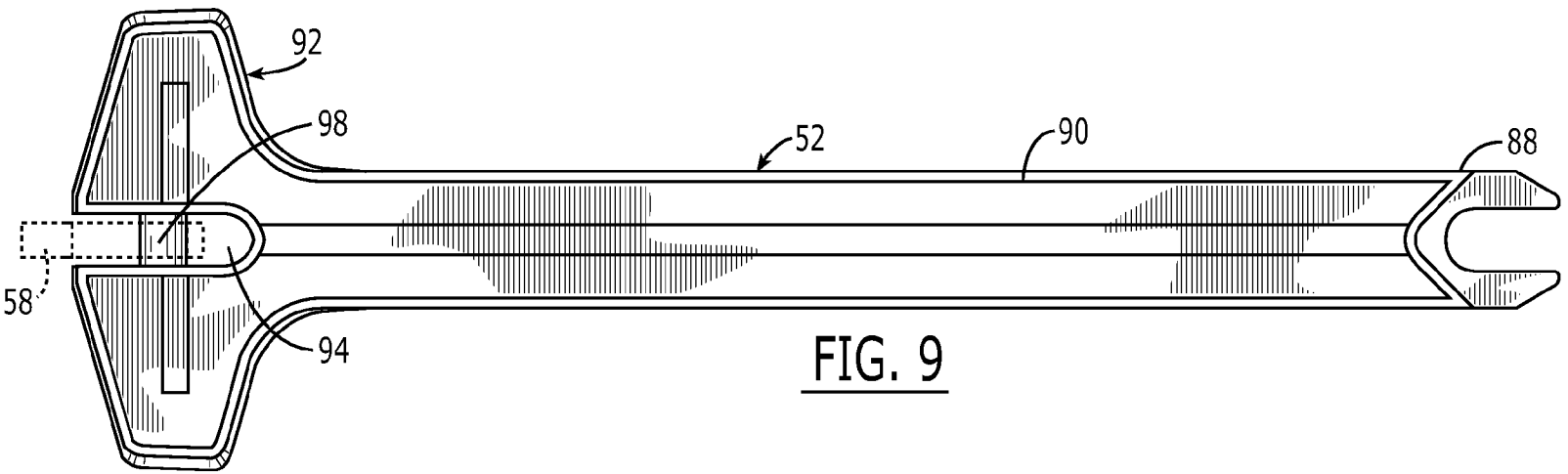
Figure 10:
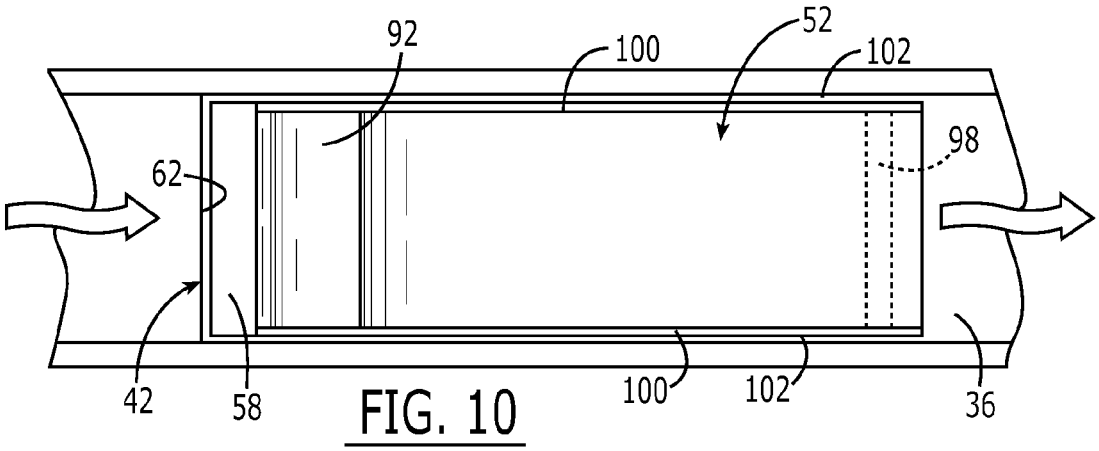
FIG. 10 is a partial top view looking down on the valve carried within the housing.

As illustrated with reference again to FIGS. 1-5, an access opening 78 within the top wall 68 provides entry into the housing 12 and the flow passage 36. A detachable cover 80 encloses the opening 78. Access to the flow passage provides a convenience when clearing out debris lodged therein or replacing the valve, by way of example. In one embodiment of the cleaner, as herein described by way of example, the partition wall 42 is integrally formed with the cover 80, as further illustrated with reference to FIG. 7. The cover 80 includes a lock 82 and tab 84 located at ends of the cover for securing the cover to the housing 12 for covering the opening 78. A pivot pin 86 is carried by the housing 12 for pivotal connection with a proximal end 88 of the valve 52. As illustrated with reference again top FIGS. 4 and 5, the valve 52 may be constructed to include an elongate arm 90 having the proximal end 88 for connection to the pivot pin 86. A head portion 92 is located at the valve distal end 60. The distal end 60 is carried within the passage 36 upstream the proximal end 88. In the embodiment illustrated with reference to FIGS. 4 and 5, by way of example, the head portion 92 includes a slot 94 for slidably receiving the retractable element 58. One embodiment of the retractable element 58 includes a slit 96 that is operable with a pin 98 carried within the slot 94, as illustrated with reference to FIGS. 8 and 9. Flexible side edges 100 extend along the longitudinal sides of the valve 52 for minimizing side gaps 102 on the sides of the valve and for providing a close fit, as further illustrated with reference to FIG. 10, thus enhancing control of the fluid flow along the one side 66 of the valve 52, as earlier described with reference to FIGS. 3-5.

Figure 11:
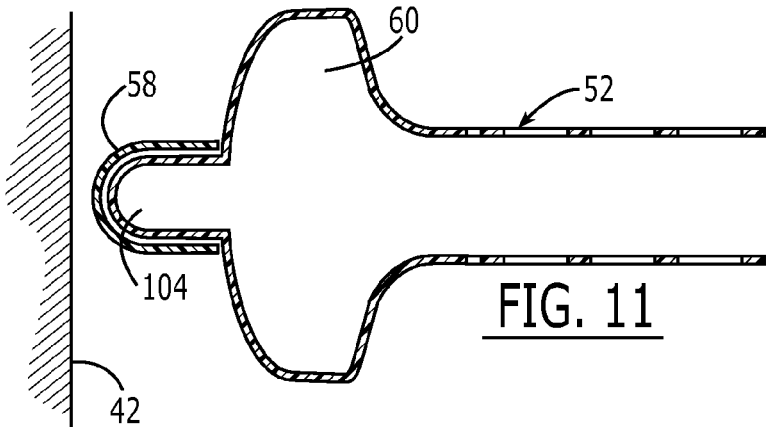
FIGS. 11, and 11A and 12 illustrate alternate embodiments having a retractable element carried by the valve and alternatively by a wall surface, respectively.
Figure 11A:
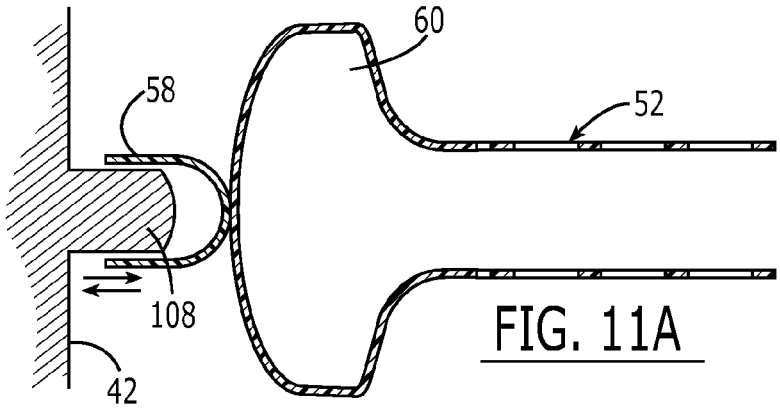
Figure 12:
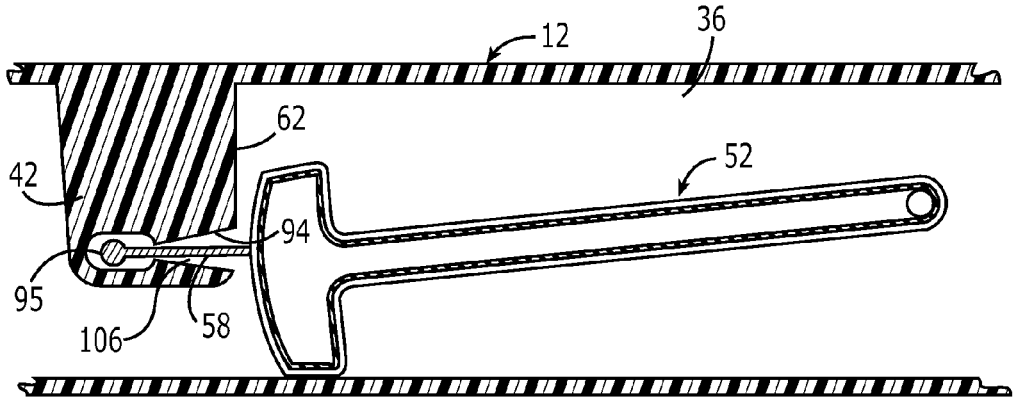
Figure 13:
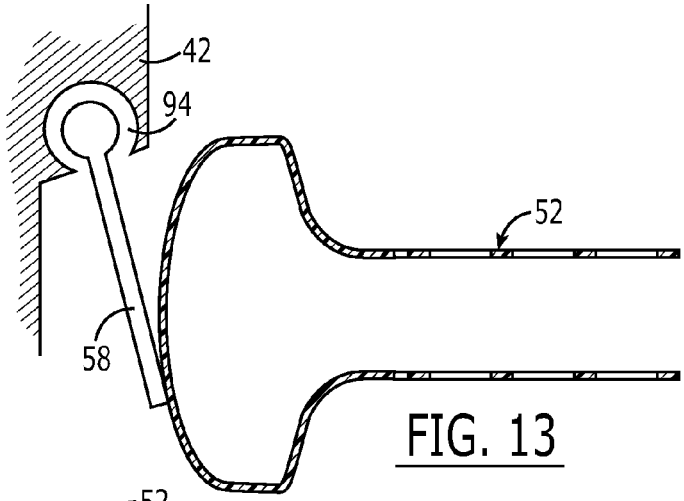
FIGS. 13 and 14 illustrate alternate embodiments of the valve operable with the retractable element, wherein a proximal end of the element is pivotal within a slot carried within the partition wall or alternatively within the head portion of the valve, respectively.
Figure 14:
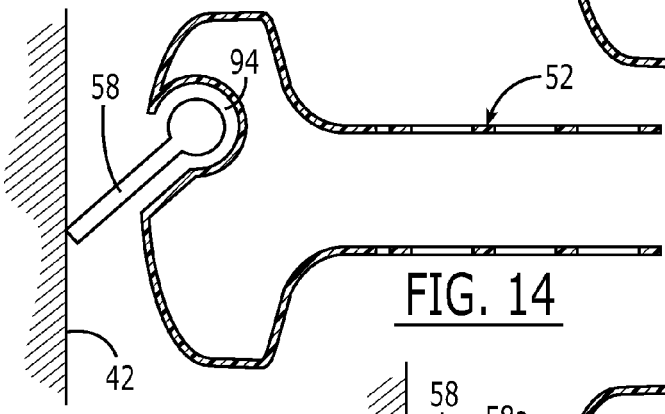

Alternate embodiments keeping within the teachings of the present invention, may include by way of example, the head portion 92 having a protrusion 104 extending radially outward from the valve distal end 60 for slidably receiving the retractable element 58, as illustrated with to reference to FIG. 11. Further, the partition wall 42 may include a slot 106 extending for slidably receiving the retractable element 58, as illustrated with reference to FIG. 12. Yet further, the partition wall 42 may include a protrusion 108 extending outward toward the valve 52 for slidably receiving the retractable element 58, as illustrated by way of further example with reference to FIG. 11A. As herein illustrated, the element 58 may have various shapes and may be attached to the valve 52 or to the partition wall 42 without deviating from the teachings of the present invention, and may or may not fully close the gap 64, as illustrated with reference to FIGS. 13-20. Which element 58 may be viewed as retracting, pivoting, or flexing as a form of retracting.

Figure 15:
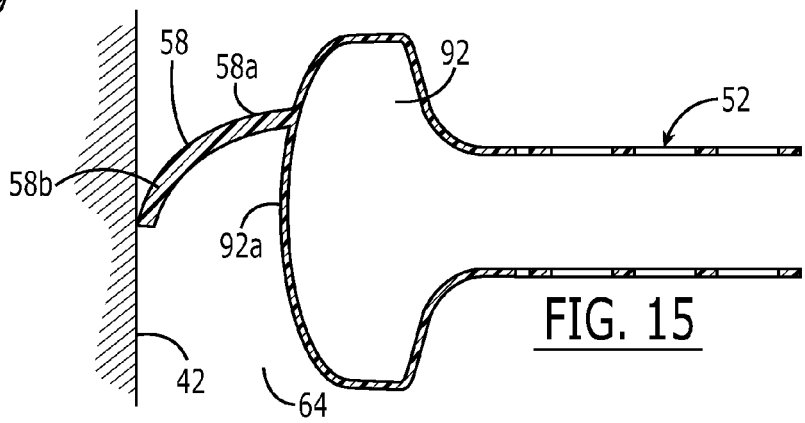
FIG. 15 is yet another embodiment of the valve illustrating in a partial cross sectional view a proximal end of the element fixed to a distal end of eth valve and a free end of the element sufficiently flexible for retracting from the partition wall in response to debris and the like passing along the partition wall.
Figure 15A:
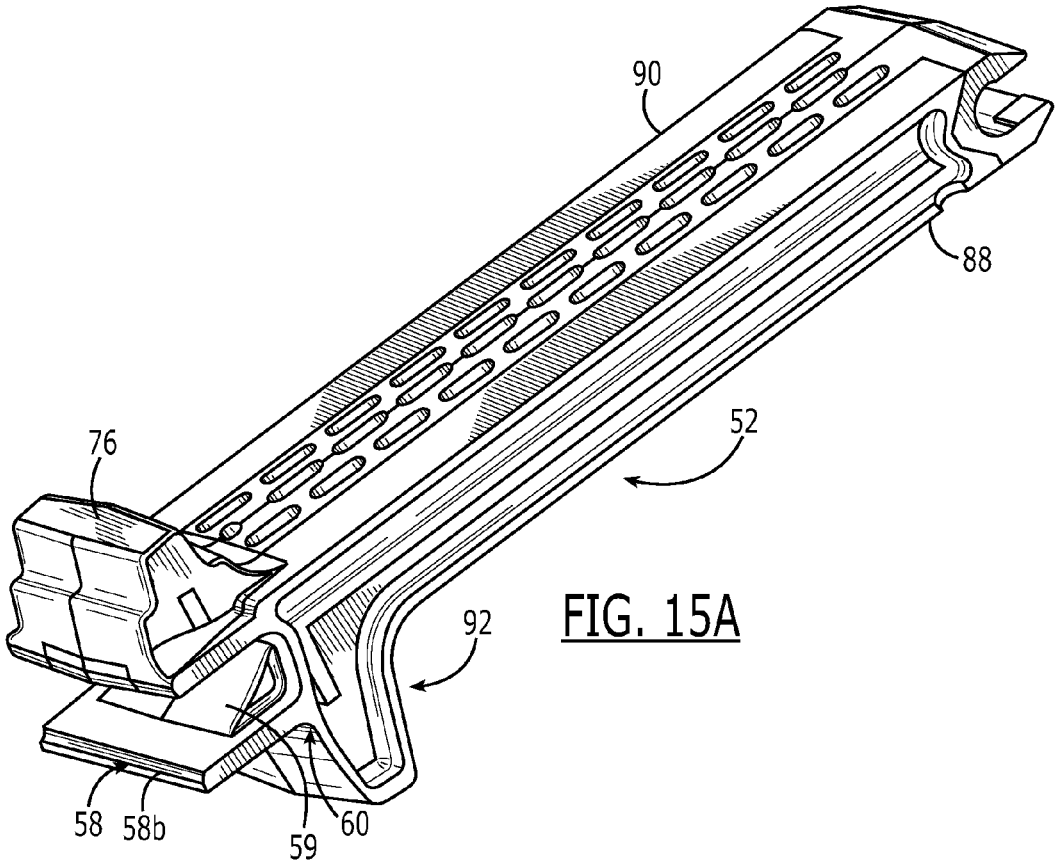
FIGS. 15A and 15B are perspective and side views respectively of alternate embodiments of the valve illustrated with reference to FIG. 15.
Figure 15B:
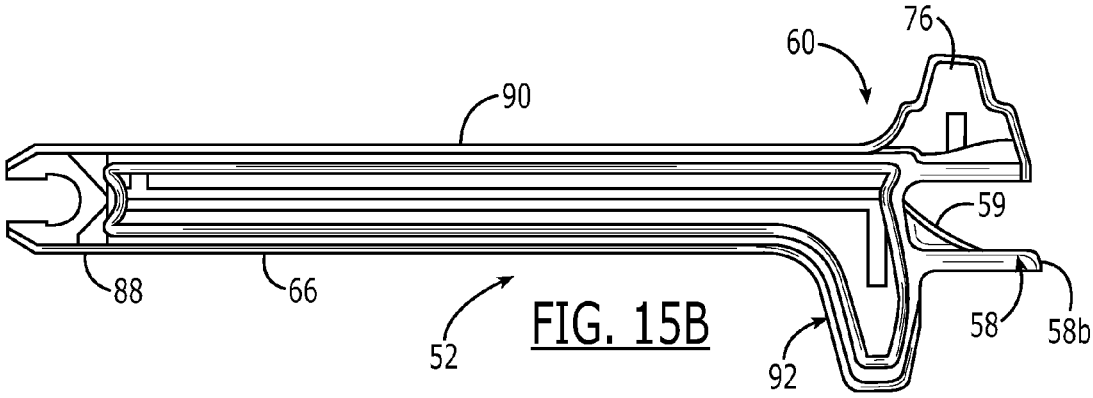
Figure 16:
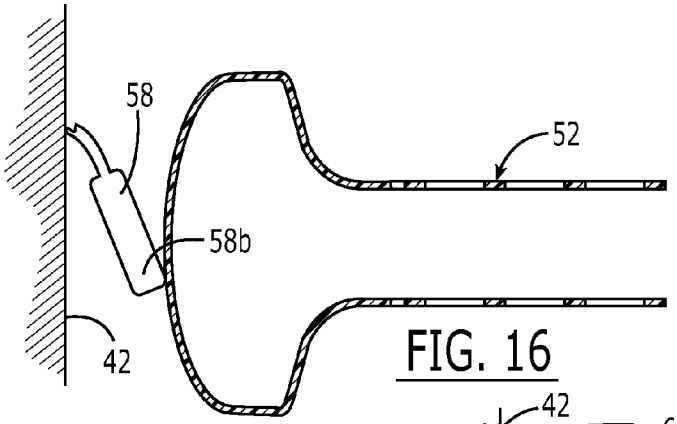
FIGS. 16-18 illustrate yet other embodiment of the element operable with the valve distal end and partition wall.
Figure 17:
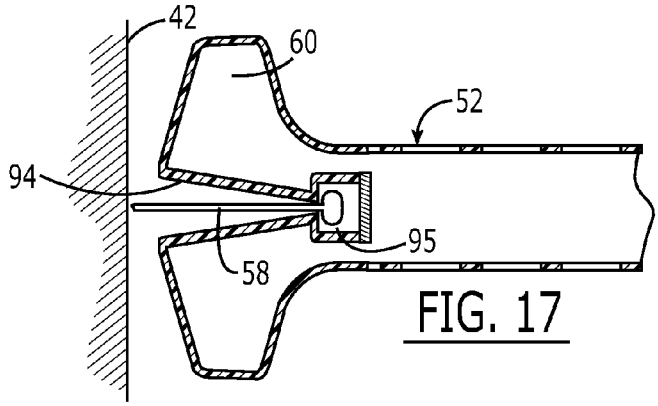
Figure 18:
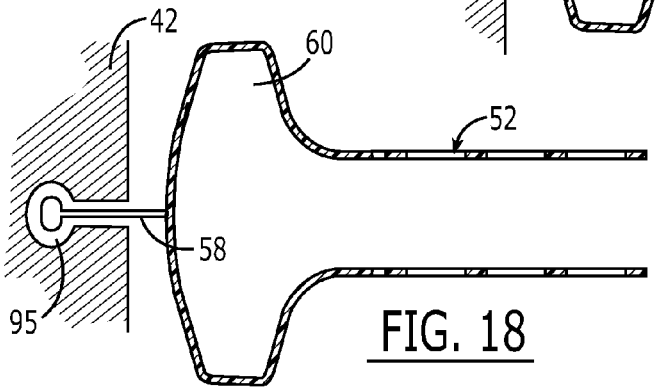

By way of further example with reference to FIGS. 15, 15A, and 15B, the element 58 may have one end 58*a* fixedly attached to the valve head portion 92 at a distal end 92*a* thereof. The element 58 may be dimensioned for reducing the gap 64 without contacting the wall 42 as illustrated with reference again to FIG. 6. Alternatively, and with continued reference to FIG. 15, a fee end 58*b* of the element 58 may contact the surface of the wall 42 and sweep across the surface of the wall 42 as the valve 50 oscillates during operation of the pool cleaner. Such sweeping movement causes the element 58 to flex and effectively retract from the wall 42, or alternatively from the valve 52 as illustrated with reference to FIG. 16 where the free end 58*b* may sweep along an end surface of the valve 52.

With reference again to FIG. 15, the valve 52 includes the element 58A operable between the distal end 60 of the valve 52 and the partition wall 42 for reducing the gap 64 formed between the distal end of the valve and the partition wall, as earlier described with reference to FIG. 5, by way of example. As earlier described with reference to FIGS. 8 and 9, and now to FIGS. 15A and 15B, the valve 52 may be described as having an elongate arm 90 having the proximal end 88 pivotally connected to a pivot pin 86 as earlier described with reference to FIGS. 5 and 6. The distal end 60 is herein described as including the head portion 92. For one embodiment of the valve 52 and with reference again to FIGS. 4 and 5, the element 58 is slideable within the slot 94 as illustrated with reference again to FIGS. 4 and 5, by way of example. Alternatively, the element 58A may be fixed to the distal end 60, as illustrated with reference to FIGS. 15A and 15B, and be sufficiently flexible at its distal end portion 57 for slideable engagement with the surface 62 of the partition wall 42, and a retraction from the partition wall as may be required to allow the debris to pass. It may further be made less flexible near its connection to the valve, as may be desired, by using a reinforcing portion 59 attached to the element 58 proximate the valve distal end 60. As will come to the minds of those skilled in the art, modifying the structure of the element 58A itself is an alternate approach to having the element less flexible near the distal end of the valve.

Figure 19:
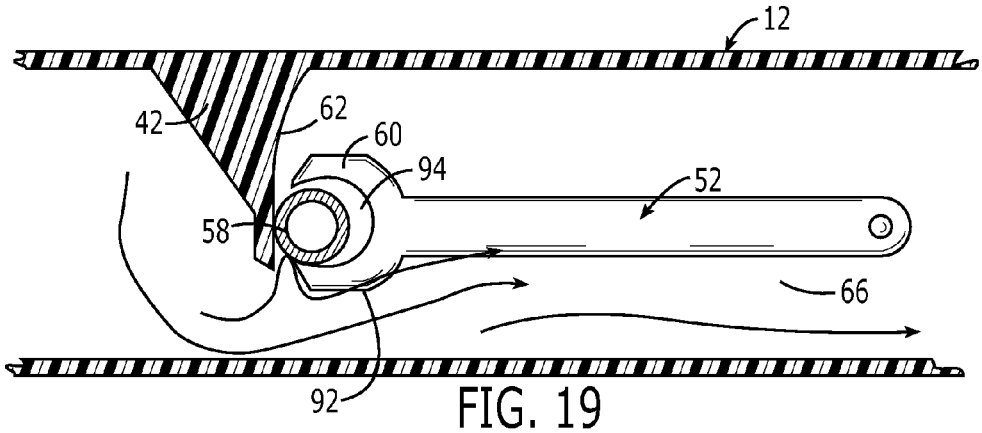
FIGS. 19 and 20 further illustrate an alternate embodiment of the element in a circular cross section form.
Figure 20:
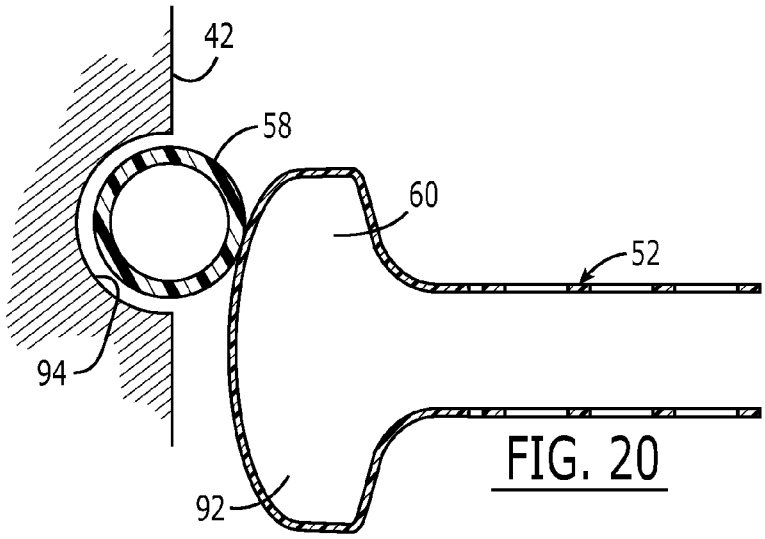

With reference to FIGS. 19 and 20, by way of example, the generally circular cross sectional shape of the retractable element 58 and carried within a generally arcuate shape for the slot 94 supports a rolling motion for the retractable element during movement of the head portion 92, thus reducing wear of the surface and element while remaining effective in directing fluid flow to the one side 66 of the valve 52. The element 58 is movably carried within the slot 94 making continuous contact with the 62 of the partition wall 42 or in close proximity as herein described. With reference again to FIGS. 6, 12, and 17, an embodiment of the valve 52 includes the head portion 92 having an angled slot 94 tapering from outside toward a slotted hole 95, or alternatively having the tapered slot within the partition wall as illustrated with reference to FIG. 18. The head contact element includes an elongate portion having one end extending out of the slot 94 and an opposing end having a bulbous portion for a sliding movement within the hole 95. Such an embodiment allows the retractable element 58 to be secured within the slot 94 during installation and easily held therein during assembly of the valve. Further, a flexible arm portion 109 may be provided as a shock buffer that results in reducing noise generated by the oscillating valve 52, as illustrated with reference again to FIG. 6.

Figure 21:
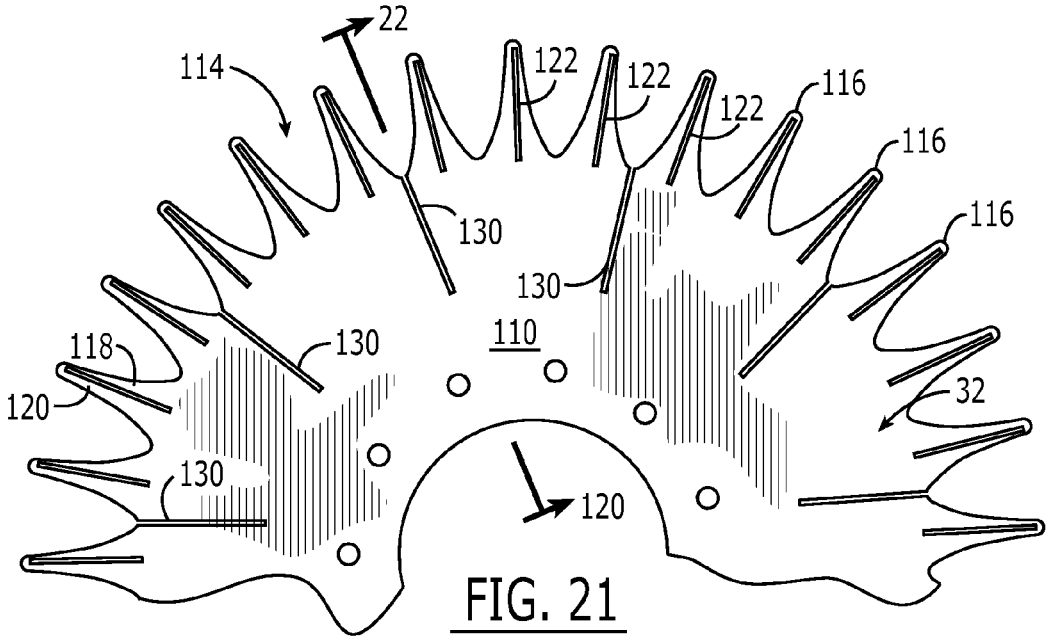
FIG. 21 is a partial top view of one embodiment of a flexible plate.
Figure 22:
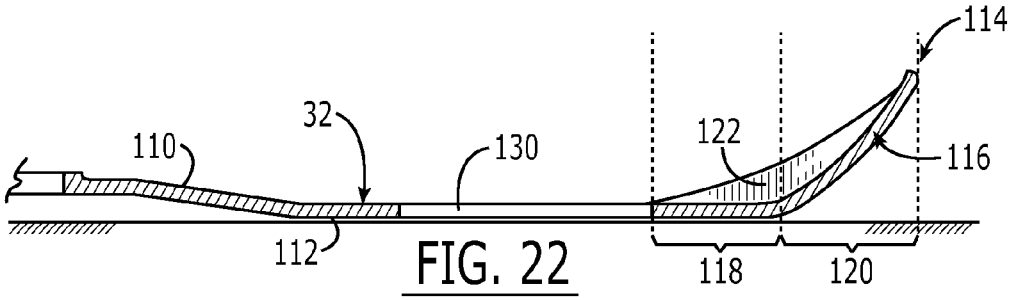
FIG. 22 is a partial cross section elevation view taken through lines 22-22 of FIG. 21.
Figure 23:
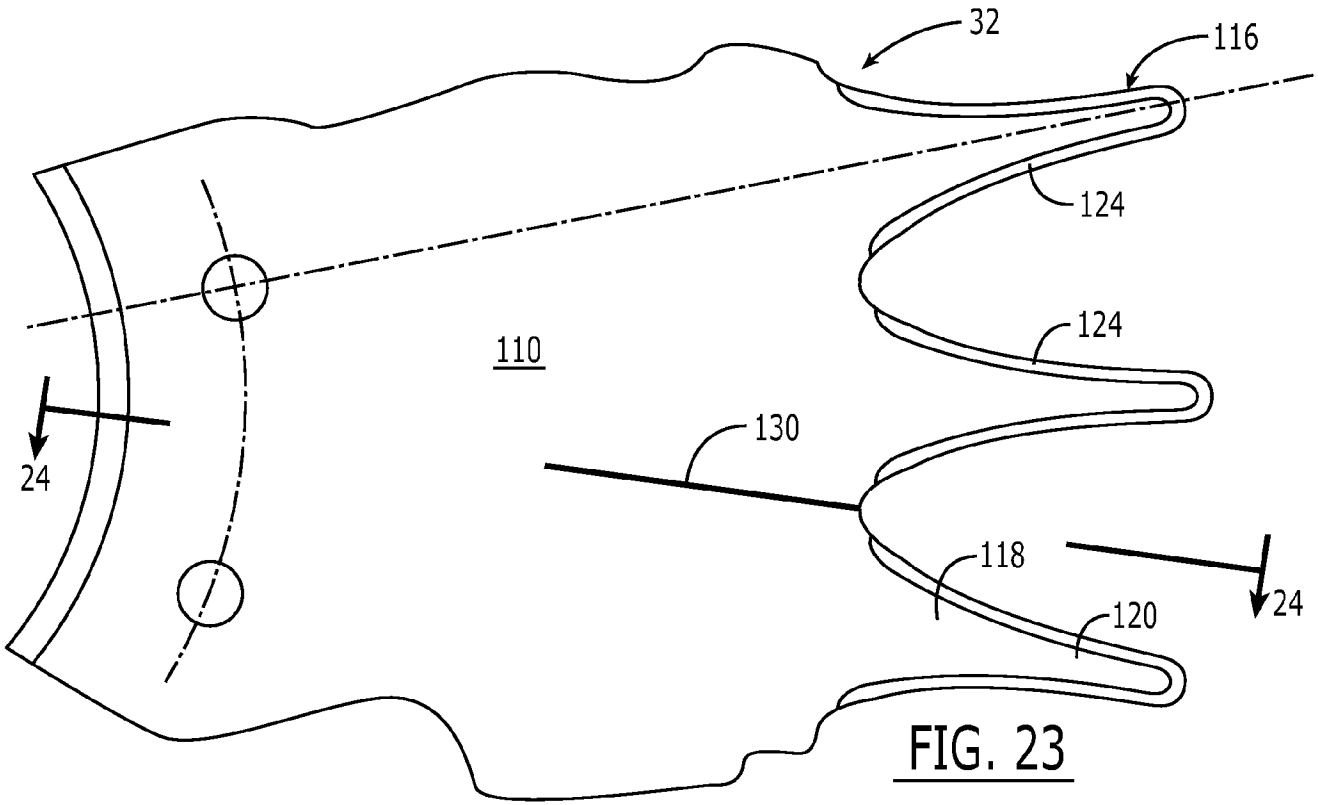
FIG. 23 is a partial top view of one embodiment of a flexible plate.
Figure 24:
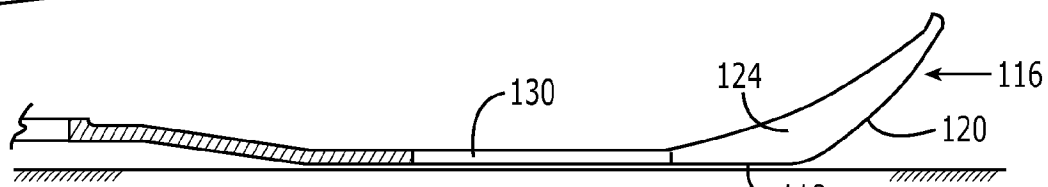
FIG. 24 is a partial cross section elevation view taken through lines 24-24 of FIG. 23.

With reference again to FIGS. 1-3, the flexible plate 32 may be described as having an upper surface 110 and an opposing lower surface 112 for contacting the surface to be cleaned 50. A periphery 114 of the plate 32 includes a plurality of tongues 116 radially extending thereabout. Each tongue 116 includes a lower surface portion 118 for contacting the surface to be cleaned 50 and a contoured portion 120 in a spaced relation with the surface to be cleaned during operation of the cleaner 10, as illustrated with reference again to FIG. 3, and to FIGS. 21 and 22, the outer most peripheral portion of the plate being upwardly lifted from the surface to be cleaned. In one embodiment, as herein illustrated, a rib 122 is integrally formed with the upper surface 110 of the flexible plate 32 at the tongue 116. The rib 122 reinforces the tongue 116 for securing the contoured portion 120 in the convex shape. Alternate reinforcing element shapes may be formed with the flexible plate 32 for upwardly contouring the periphery 114 upwardly from the surface to be cleaned 50, including a flange 124 extending along a peripheral edge of the tongue, as illustrated by way of example with reference to FIGS. 23 and 24.

Figure 25:
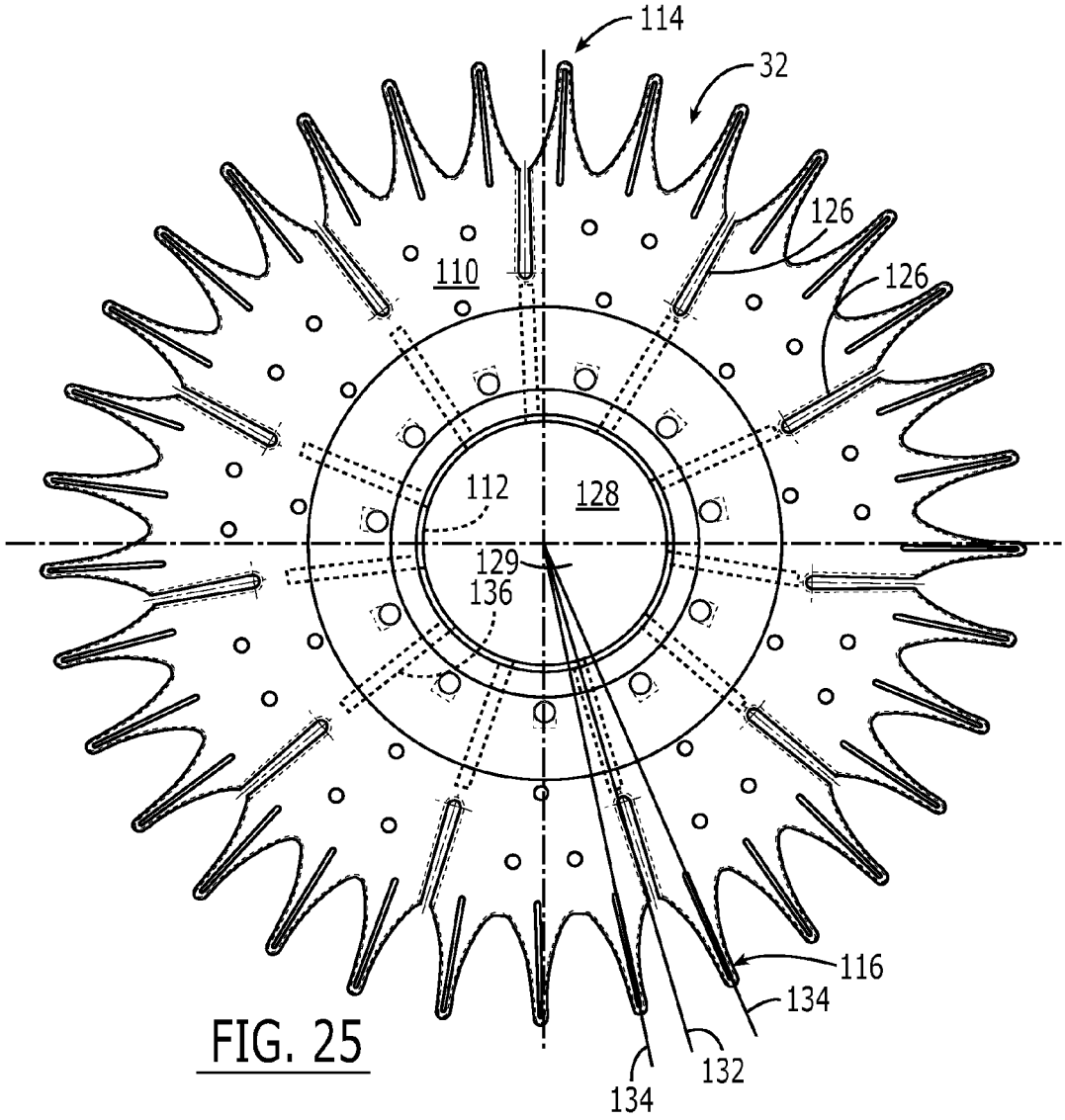
FIG. 25 is a top plan view of one embodiment of a flexible plate.

As illustrates with reference again to FIG. 2 and to FIG. 25, embodiments of the plate 32 may include slots 126 radially extending from a center 128 of the plate. The slot 126 herein described is tapered so as to provide a diminishing gap as the taper extends radially outward from the center 128. Alternatively, the plate 32 may include a slit 130, as illustrated with reference again to FIGS. 22 and 24. Yet further, a combination of tapered slot 126 and slit 130 may be formed within the plate 32, as illustrated with reference to FIG. 26, such slots and slits extending radially outward from the center 128 of the plate 32 provide added flexibility to the flexible plate 32 and improved maneuverability over contours within the surface to be cleaned 50. A plurality of slots or slit may be symmetrically located as herein illustrated or located as desired for surface conditions.

By way of further example, and as illustrated with reference again to FIG. 25, the plurality of slots may extend along a first imaginary line 132 centrally positioned between second imaginary lines 134 passing centrally through each of the plurality of tongues 116. Further, the plate 32 may include grooves 136 within the lower surface 112 and extending radially outward for the center 128. As illustrated, the grooves 136 may extend only partially between the center 128 and the periphery 114 of the plate 32.

Figure 29:
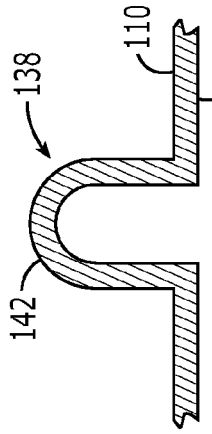
FIG. 29 is a partial cross section view taken through lines 29-29 of FIG. 27.
Figure 27:
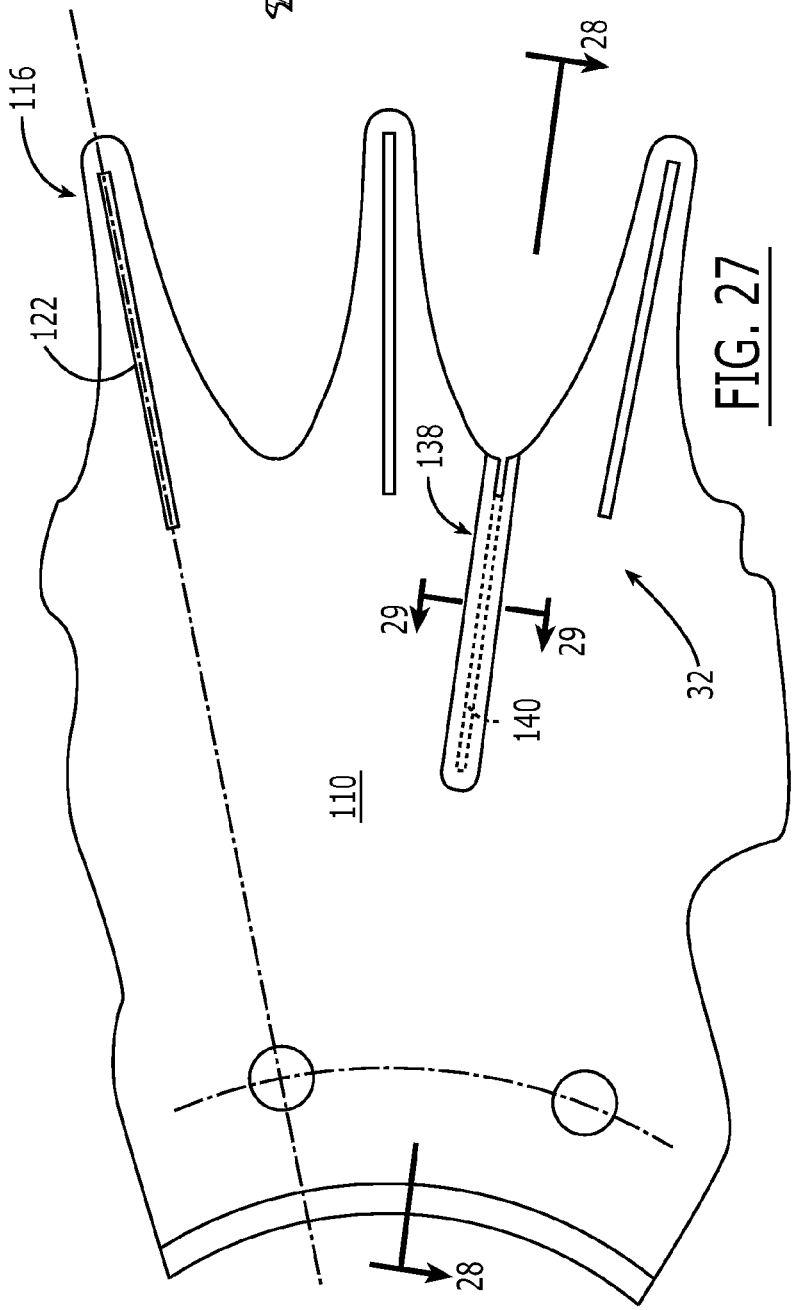
FIG. 27 is a partial top view of one embodiment of a flexible plate.
Figure 28:
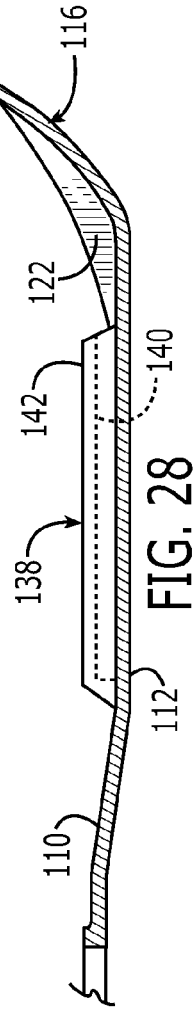
FIG. 28 is a partial cross section elevation view taken through lines 28-28 of FIG. 27.

Pleats 138 provide yet another alternative for adding flexibility to the plate 32, as illustrated with reference FIGS. 27-29. Each of a plurality of pleats 138 extending radially from the center 128 forms a groove 140 within the lower surface 112 and a protrusion 142 in the upper surface 110.

Figure 26:
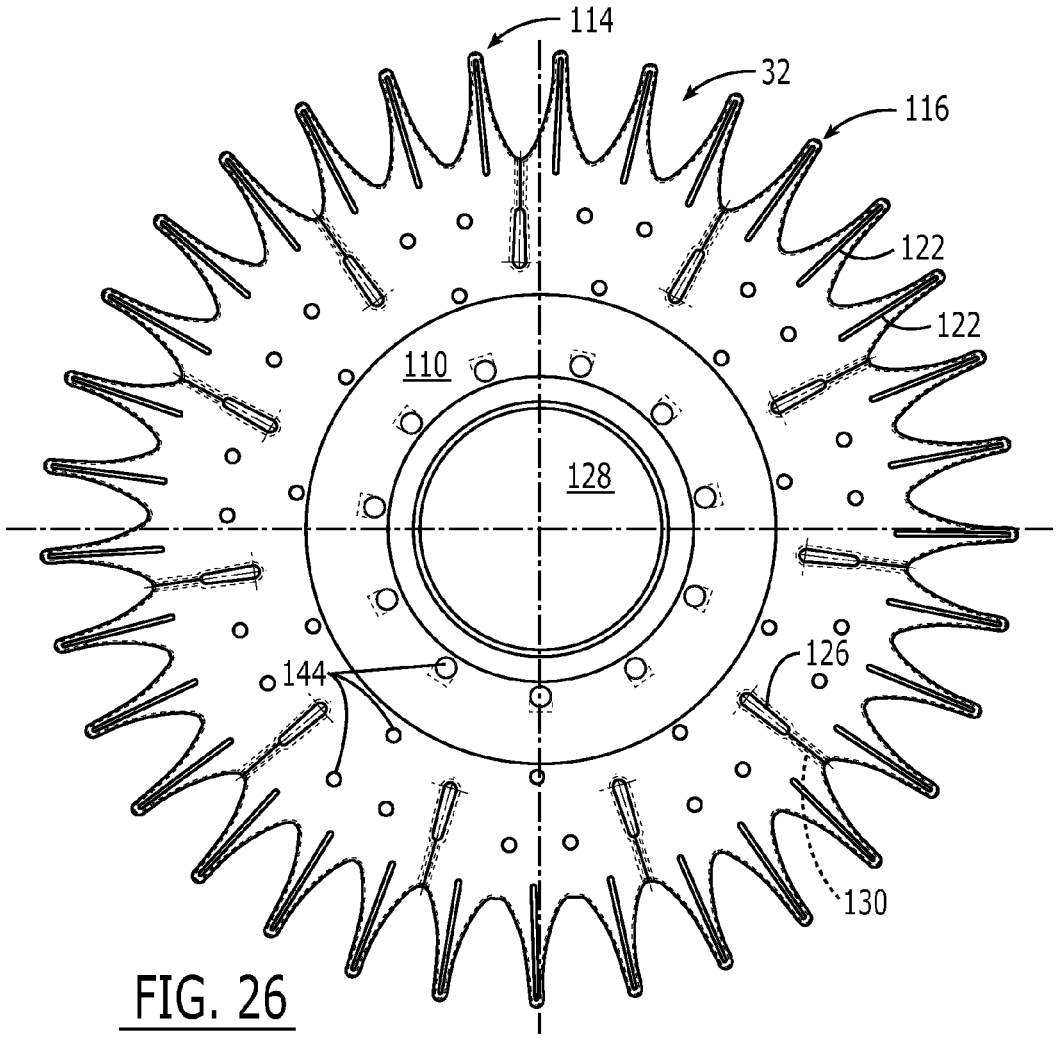
FIG. 26 is a top plan view of an alternate embodiment of a flexible plate.

With reference to FIG. 26, by way of example, the plate 32 may include a plurality of holes 144 extending from the upper surface 110 to the lower surface 112 for modifying a suction provided by the flexible plate during operation of the cleaner 10 with the suction source.

Figure 30:
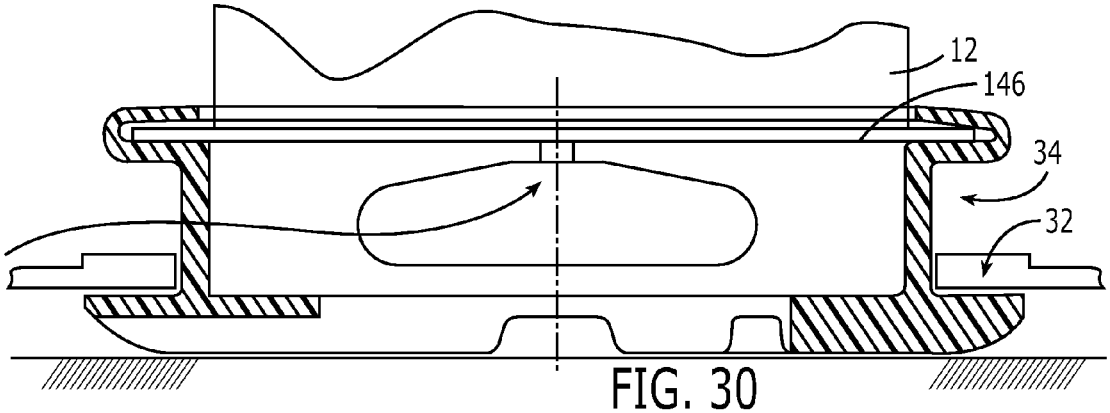
FIG. 30 is an elevation and partial cross section view of a footpad of FIG. 1.
Figure 31:
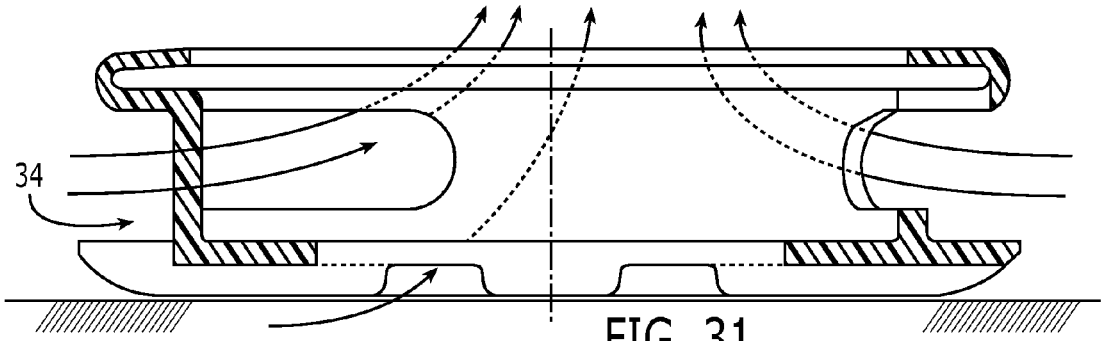
FIG. 31 is a side elevation and partial cross section view of the footpad of FIG. 30 illustrating front and rear lateral inlet ports.
Figure 32:
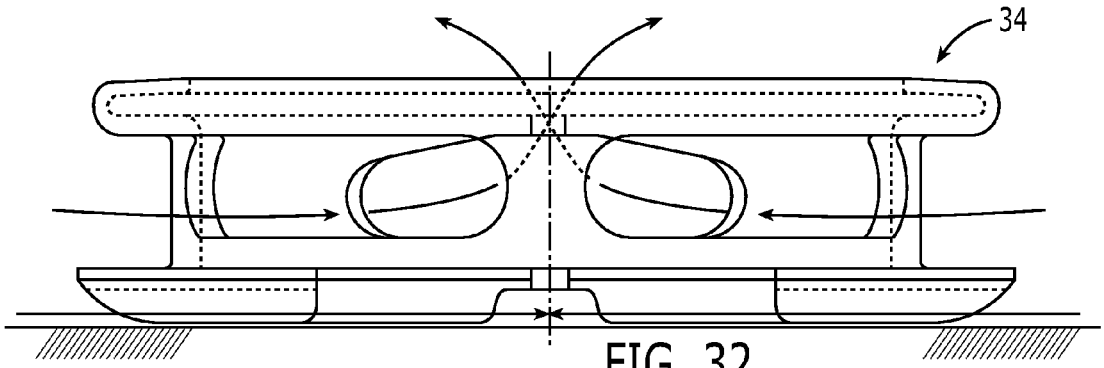
FIG. 32 is an elevation view of the footpad of FIG. 30 illustrating dual lateral inlet ports.

As earlier described with reference to FIGS. 1-3, the cleaner 10 herein described by way of example, includes a foot pad 34 which carries the plate 32. The foot pad 34 is attached to a flange 146 at the inlet 38 of the housing 12 as further illustrated with reference to FIG. 30. The footpad 34 is attached to the housing 12 and the flexible plate 32, and easily replaced by the consumer. As illustrated with reference to FIGS. 31 and 32 using arrows, fluid flow passes through openings within the footpad above the plate and below for providing an effective cleaning of debris from the surface to be cleaned. As illustrated with reference again to FIGS. 1-3, a hose connector 148 is carried at the outlet 40 of the housing 12. Under the influence of the vacuum source 48, typically a pump, a flexible hose 150 connected to the connector 148 causes fluid and debris to flow through the housing 12.

As illustrated with reference again to FIGS. 1-3, one embodiment of the hose connector 148 includes a swivel portion 152, nut portion 154 and collar 156 for providing a swivel connection to the hose 150. Such a combination permits easy replacement of parts. A key 158 is carried by the collar 156 to fix the bumper 14 in a forward position.

Various embodiments of the present invention have been herein described in the drawings and specification, by way of example. Although specific terminology was employed, the terms are used in a descriptive sense only and not for purposes of limitation. The invention has been described in detail with specific reference to these illustrated embodiments. However, it will be apparent that various modifications and changes may be made while keeping within the teachings and scope of the invention as described in the foregoing specification and as defined in claims.

That which is claimed is:

1. An apparatus for cleaning surfaces submerged in a fluid, the apparatus comprising:

a housing having a flow passage extending from an inlet to an outlet for a flow of fluid and debris therethrough;

a generally rigid wall surface extending generally perpendicular into the flow passage, the generally rigid wall surface forming a portion of the flow passage such that fluid and debris are constrained to flow past the wall surface;

a valve operable within the flow passage for interrupting the flow through the passage during an oscillation of the valve about a proximal end thereof; and an element operable between a distal end of the valve and the wall surface for reducing a gap therebetween, the element extending sufficiently toward the wall surface to substantially limit the flow toward the outlet to only one side of the valve.

2. An apparatus according to claim 1, wherein the element comprises a retractable element dimensioned such that the fluid flow through the passage causes the retractable element to have slideable engagement between the valve distal end and the wall surface during the oscillation of the valve.

3. An apparatus according to claim 2, wherein the retractable element is moveable generally radially about an axis of rotation of the valve.

4. An apparatus according to claim 2, wherein the retractable element is sufficiently flexible to allow a distal portion thereof to be retractable.

5. An apparatus according to claim 2, wherein the distal end includes a slot slidably receiving the retractable element therein.

6. An apparatus according to claim 2, wherein the distal end includes a protrusion extending outwardly therefrom and slidably receiving the retractable element thereon.

7. An apparatus according to claim 2, wherein the wall surface comprises a partition wall having a slot extending therethrough and slidably receiving the retractable element therein.

8. An apparatus according to claim 2, wherein the wall surface includes a protrusion extending outward therefrom and slidably receiving the retractable element thereon.

9. An apparatus according to claim 1, wherein the element is attached to one of the valve distal end and the wall surface.

10. An apparatus according to claim 9, wherein the element further comprises a reinforcing portion attached thereto for modifying a flexibility thereof.

11. An apparatus according to claim 9, wherein the element comprises at least one of a retractable element and a flexible element moveable between the valve distal end and the wall surface.

12. An apparatus according to claim 1, wherein the element comprises a flexible element dimensioned such that the flow of fluid and debris through the passage causes the flexible element to have slideable engagement with at least one of the valve distal end and the wall surface during oscillation of the valve.

13. An apparatus according to claim 12, wherein the flexible element is fixed to one of the valve distal end and the wall surface.

14. An apparatus according to claim 1, wherein the flow passage comprises a single flow passage defined by opposing top and bottom walls in combination with opposing sidewalls, and wherein the valve distal end contacts the bottom wall in a seated position and oscillates between the seated position and an opposing stop.

15. An apparatus according to claim 14, wherein the top wall comprises an access opening enclosed by a detachable cover, the access opening providing access to the valve.

16. An apparatus according to claim 15, wherein the wall surface is integrally formed with the detachable cover.

17. An apparatus according to claim 1, further comprising a pivot pin carried by the housing, wherein the valve proximal end is detachably connected to the pivot pin for rotation thereabout.

18. An apparatus comprising:

a housing having a flow passage including top and bottom walls extending therethrough from an inlet to an outlet;

a generally rigid wall surface extending generally perpendicular into the flow passage;

a valve operable within the flow passage for interrupting fluid flow therethrough, the valve moveable between the top and bottom walls during an oscillation of the valve; and an element extending between the valve and the generally rigid wall surface for reducing a gap formed therebetween, the element extending from at least one of the valve and the wall surface to substantially limit the flow to only one side of the valve and along one of the top and bottom walls.

19. An apparatus according to claim 18, wherein the element is attached to at least one of the valve and the wall surface.

20. An apparatus according to claim 19, wherein the element further comprises a reinforcing portion attached thereto for modifying a flexibility thereof.

21. An apparatus according to claim 18, wherein the element comprises at least one of a retractable element and a flexible element.

22. An apparatus according to claim 21, wherein one of the wall surface and the valve includes a slot slidably receiving the retractable element for movement within the slot.

23. An apparatus for cleaning surfaces submerged in a fluid, the apparatus comprising:

a housing having a flow passage extending therethrough, wherein a generally rigid wall surface extending generally perpendicular into the flow passage forms a portion of the flow passage;

a valve operable within the flow passage for interrupting the flow through the passage during an oscillation of the valve about a proximal end thereof, the valve having a longitudinal axis extending toward the wall surface; and an element operable between a distal end of the valve and the wall surface for reducing a gap therebetween, wherein the element is positioned for substantially limiting the flow of fluid to only one side of the valve along the longitudinal axis thereof.

24. An apparatus according to claim 23, wherein the element is attached to at least one of the valve distal end and the wall surface.

25. An apparatus according to claim 23, wherein the element further comprises a reinforcing portion attached thereto for modifying a flexibility thereof.

* * * * *